United States Patent [19]

Asami et al.

[11] Patent Number: 4,467,339

[45] Date of Patent: Aug. 21, 1984

[54] THERMOSENSITIVE RECORDING MATERIAL

[75] Inventors: Shinichi Asami; Hiroshi Sakamoto; Norihiko Inaba, all of Numazu, Japan

[73] Assignee: Ricoh Company, Ltd., Tokyo, Japan

[21] Appl. No.: 385,210

[22] Filed: Jun. 4, 1982

[30] Foreign Application Priority Data

Jun. 11, 1981 [JP] Japan ..... 56-90046

[51] Int. Cl.[3] ..... B41M 5/18

[52] U.S. Cl. ..... 346/214; 346/216; 346/217; 346/220; 346/221; 346/225

[58] Field of Search ..... 282/27.5; 427/150, 151; 428/320.4–320.8, 411, 488, 537, 913, 914

[56] References Cited

U.S. PATENT DOCUMENTS

| | | | |
|---|---|---|---|
| 3,244,550 | 4/1966 | Farnham et al. | 282/27.5 |
| 4,054,718 | 10/1977 | Garner et al. | 282/27.5 |
| 4,255,491 | 3/1981 | Igarashi et al. | 282/27.5 |
| 4,339,492 | 7/1982 | Mino et al. | 428/320.4 |
| 4,399,188 | 8/1983 | Yamato et al. | 428/320.4 |

*Primary Examiner*—Bruce H. Hess

*Attorney, Agent, or Firm*—Flynn, Thiel, Boutell & Tanis

[57] ABSTRACT

An improved thermosensitive recording material comprising a support material is disclosed and a thermosensitive coloring layer formed on the support material, the thermosensitive coloring layer comprising (a) a colorless or light-colored coloring material and (b) a developing material capable of coloring the coloring material upon application of heat thereto, said developing material comprising a p-hydroxybenzoic acid ester of the formula (I) and a bisphenol derivative of the formula (II), with a melting point ranging from 80° C. to 130° C., the formulas (I) and (II) being:

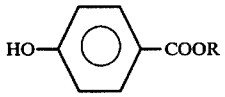

(I)

wherein R represents alkyl having 1 to 4 carbon atoms, or benzyl,

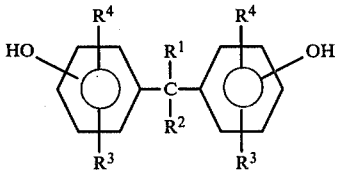

(II)

wherein $R^1$ represents hydrogen or methyl; $R^2$ represents hydrogen or alkyl having 1 to 5 carbon atoms; $R^3$ represents hydrogen or methyl; and $R^4$ represents hydrogen or alkyl having 1 to 4 carbon atoms.

11 Claims, No Drawings

THERMOSENSITIVE RECORDING MATERIAL

BACKGROUND OF THE INVENTION

The present invention relates to an improved thermosensitive recording material, and more particularly to a thermosensitive recording material comprising a support material and a thermosensitive coloring layer formed on the support material, which thermosensitive coloring layer comprises a colorless or light-colored coloring material and a developing material, which developing material contains p-hydroxybenzoic acid ester and a bisphenol derivative, and which colors the coloring material upon application of heat thereto.

Recently, thermosensitive recording materials have been employed in a variety of fields, for instance, for use with printers of computers, recorders of medical analytical instruments, facsimile apparatus, automatic ticket vending apparatus, and thermosensitive copying apparatus, since they have the following advantages over other recording materials:

(1) Images can be formed by simple heat application, without any complicated steps for development.

(2) The thermosensitive recording materials can be produced by a simple apparatus and the storage of the thermosensitive recording materials is simple and does not involve excessive costs.

(3) As the support material of the thermosensitive recording materials, paper is usually used, which is rather inexpensive in comparison with other support materials, such as synthetic resin films.

(4) When paper is used as the support material, the thermosensitive recording material has a pleasing plain-paper-like touch.

A conventional thermosensitive recording material is produced by coating on a support material (for instance, a sheet of paper or a synthetic resin film) a thermosensitive coloring liquid, containing a coloring material and a developing material, which can be colored when heated, and then by drying the coloring liquid to form a thermosensitive coloring layer.

Images are formed and recorded in the thus produced thermosensitive recording material by heat application by use of a thermal pen or head.

Thermosensitive recording materials of the above-described type are disclosed, for instance, in Japanese Patent Publications No. 43-4160 and No. 45-14039. Such thermosensitive recording materials, however, have the following shortcomings.

During the application of heat to the recording material for recording by a thermal pen or head, materials contained in the thermosensitive coloring layer are fused and adhere, in the form of particles, to the thermal pen or head. The particles then stick to the thermosensitive recording material itself and hinder the feeding thereof, or they are transferred back to the recording material, leaving trailing marks on the recording material.

Furthermore, when the sticky particles accumulate on the thermal pen or head, image density and image sharpness tend to decrease, and images are deformed.

These conventional thermal recording materials are also slow in thermal response, not allowing rapid recording with high image density and high image sharpness, and there is in fact a keen demand for rapid recording, for instance, in facsimile, and recorders for computers and medical analytical instruments. The thermal response of thermal recording materials is called their "head matching property" and is considered to be an important factor when evaluating the quality of thermal recording materials.

In Japanese Laid-open Patent Application No. 48-19231, there is disclosed a method of adding waxes with a melting point in the range of 40° C. to 100° C. to the thermosensitive coloring layer of a thermal recording material in an attempt to improve the thermal response.

In Japanese Patent Publication No. 51-27599, there is disclosed a method of adding a fatty acid amide and a petroleum wax to the thermosensitive coloring layer in an attempt to improving the thermal response and to reduce the adhering of sticky particles to the thermal head.

By these methods, however, the sticky particles, the adhesion thereof to the thermal head and the trailing marks formed on the thermosensitive recording material by the particles cannot be eliminated sufficiently for practical use and, accordingly, high image density and high image sharpness that are acceptable for practical use cannot be obtained.

SUMMARY OF THE INVENTION

It is therefore an object of the present invention to provide an improved thermosensitive recording material from which the above-described shortcomings of the conventional thermosensitive recording materials are eliminated.

According to the present invention, this object is attained by use of a p-hydroxybenzoic acid ester and a bisphenol derivative in combination as a developing material in a thermosensitive recording material of the type comprising a support material and a thermosensitive coloring layer formed on the support material, which thermosensitive coloring layer comprises a colorless or light-colored coloring material and a developing material which colors the coloring material when heat above a predetermined temperature is applied thereto.

The above-described object can be attained to some extent by use of only a p-hydroxybenzoic acid ester. By use of a bisphenol derivative in combination with the p-hydroxybenzoic acid ester, resistance to deterioration of the images on the thermosensitive recording material can be significantly improved.

DETAILED DESCRIPTION OF THE PREFERRED EMBODIMENTS

A thermosensitive recording material according to the present invention comprises a support material and a thermosensitive coloring layer formed on the support material, which thermosensitive coloring layer comprises a colorless or light-colored coloring material and a developing material capable of coloring the coloring material upon application of heat thereto, with a key feature thereof being that the developing material comprises at least one of the p-hydroxybenzoic acid esters with a melting point in the range of 60° C. to 120° C. of the general formula (I) and at least one of the bisphenol derivatives with a melting point in the range of 80° C. to 130° C. of the general formula (II). The formulas (I) and (II) are:

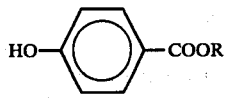

(I)

where R represents alkyl having 1 to 4 carbon atoms, or a benzyl and

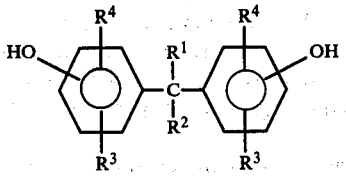

(II)

where $R^1$ represents hydrogen or methyl; $R^2$ represents hydrogen or alkyl having 1 to 5 carbon atoms; $R^3$ represents hydrogen or methyl; and $R^4$ represents hydrogen or alkyl having 1 to 4 carbon atoms.

The p-hydroxybenzoic acid esters employed in the present invention have excellent developing capability and quick thermal response, and yield uniform and high image density, in comparison with conventional developers such as 4,4'-isopropylidene diphenol and 4,4'-butylidene diphenol.

The bisphenol derivatives employed in the present invention somehow serve to prevent the fading of images. It is considered that this function of the bisphenol derivatives relates to the eutectic properties with the p-hydroxybenzoic acid esters.

Specific examples of the p-hydroxybenzoic acid esters of the general formula (I) are as follows:

| | |
|---|---|
| methyl p-hydroxybenzoate | m.p. 125° C. to 128° C. |
| ethyl p-hydroxybenzoate | m.p. 116° C. to 118° C. |
| n-propyl p-hydroxybenzoate | m.p. 96° C. to 98° C. |
| iso-propyl p-hydroxybenzoate | m.p. 84° C. to 86° C. |
| iso-butyl p-hydroxybenzoate | m.p. 75° C. to 77° C. |
| benzyl p-hydroxybenzoate | m.p. 111° C. |

Specific examples of the bisphenol derivatives of the general formula (II) are as follows:

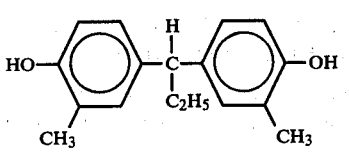

(m.p. 94° C.)

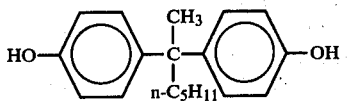

(m.p. 99° C.~103° C.)

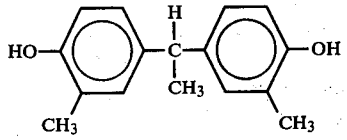

(m.p. 100° C.~102° C.)

-continued

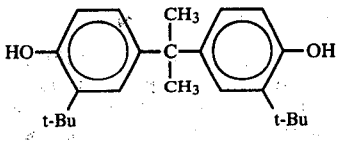

(m.p. 116° C.~118° C.)

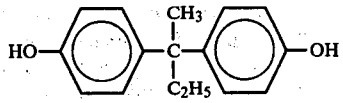

(m.p. 118° C.~121° C.)

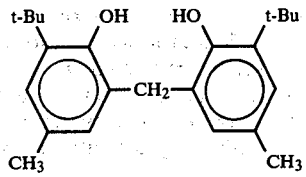

(m.p. 120° C.)

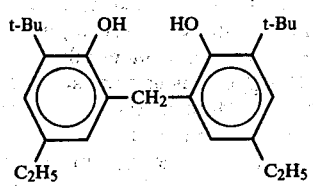

(m.p. 125° C.~130° C.)

In the present invention, the developing material comprising a combination of the above-described p-hydroxybenzoic acid esters (at least one) and the bisphenol derivatives (at least one) is employed in an amount of 1 to 10 parts by weight, preferably in an amount of 2 to 5 parts by weight, with respect to 1 part by weight of the coloring materials which will be described later in detail.

The ratio by weight of the p-hydroxybenzoic acid ester of the general formula (I) to the bisphenol derivative of the general formula (II) employed in the present invention is in the range of 0.1 to 5, preferably in the range of 0.2 to 2.

In addition to the above developing material, other conventional developing materials can also be employed. In this case, the content of the bisphenol derivative of the general formula (II) should be at least 10 weight percent of the entire developing material, preferably more than 20 weight percent of the entire developing material.

As the coloring material for use in the thermosensitive coloring layer, the conventional coloring materials for use in this field, such as triphenylmethane-type leuco compounds, fluoran-type leuco compounds, phenothiazine-type leuco compounds, Auramine-type leuco compounds and spiropyran-type leuco compounds, can be employed. Among those compounds, the following coloring materials are particularly suitable for the present invention:

(1) Triphenylmethane-type leuco compounds of the general formula:

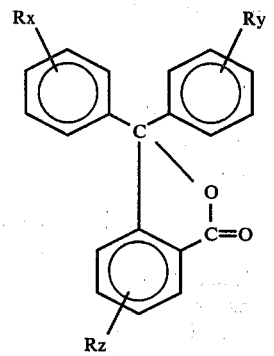

wherein $R_x$, $R_y$ and $R_z$ are individually hydrogen, hydroxyl, halogen, alkyl, nitro, amino, dialkylamino, monoalkylamino or aryl.

Specific examples of the above compounds are as follows:

3,3-bis(p-diethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide, and
3,3-bis(p-dibutylaminophenyl)-phthalide.

(2) Fluoran-type leuco compounds of the general formula

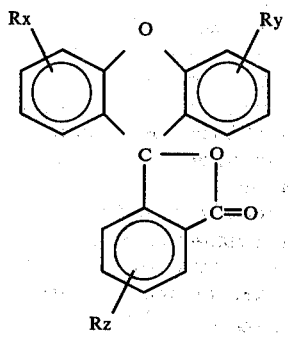

wherein $R_x$, $R_y$ and $R_z$ are individually hydrogen, hydroxyl, halogen, alkyl, nitro, amino, dialkylamino, monoalkylamino or aryl.

Specific examples of the above compounds are as follows:

3-cyclohexylamino-6-chlorofluoran,
3-(N,N-diethylamino)-5-methyl-7-(N,N-dibenzylamino)fluoran,
3-dimethylamino-5,7-dimethylfluoran,
3-diethylamino-7-methylfluoran, and
3-diethylamino-7,8-benzfluoran.

(3) Other fluoran-type leuco compounds 3-diethylamino-6-methyl-7-chlorofluoran,
3-pyrrolidino-6-methyl-7-anilinofluoran,
2-[N-(3'-trifluoromethylphenyl)amino]-6-diethylaminofluoran, and
2-[3,6-bis(diethylamino)-9-(o-chloroanilino) xanthylbenzoic acid lactam].

(4) Lactone compounds of the general formula

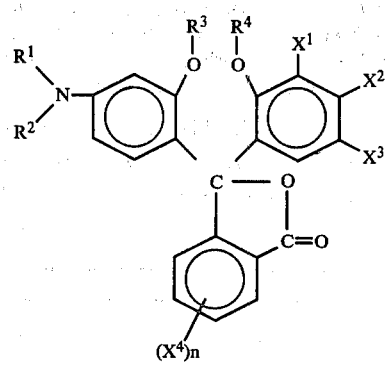

wherein $R^1$ and $R^2$ individually represent hydrogen, lower alkyl, substituted or unsubstituted aralkyl, substituted or unsubstituted phenyl, cyanoethyl, or $\beta$-halogenated ethyl, or $R^1$ and $R^2$ in combination represent $-CH_2)_4$, $-CH_2)_5$, or $-CH_2)_2O-CH_2)_2$; $R^3$ and $R^4$ individually represent hydrogen, lower alkyl, amino or phenyl, and either $R^3$ or $R^4$ is hydrogen; $X^1$, $X^2$ and $X^3$ individually represent hydrogen, lower alkyl, lower alkoxy, halogen, halogenated methyl, nitro, or substituted or unsubstituted amino; $X^4$ represents hydrogen, halogen or lower alkyl; and n is an integer 0 to 4.

Specific examples of the above-mentioned compounds are as follows:

3-(2'-hydroxy-4'-dimethylaminophenyl)-3-(2'-methoxy-5'-chlorophenyl) phthalide,
3-(2'-hydroxy-4'-dimethylaminophenyl)-3-(2'-methoxy-5'-nitrophenyl) phthalide,
3-(2'-hydroxy-4'-diethylaminophenyl)-3-(2'-methoxy-5'-methylphenyl) phthalide, and
3-(2'-methoxy-4'-dimethylaminophenyl)-3-(2'-hydroxy-4'-chloro-5'-methylphenyl) phthalide.

In the thermosensitive coloring layer of a thermosensitive recording material according to the present invention, the following binder agents can be employed:

Water-soluble organic polymers, such as polyvinyl alcohol, starch, starch derivatives, cellulose derivatives, sodium polyacrylate, polyvinylpyrrolidone and styrene/maleic anhydride copolymer; and water emulsions of polymers, such as SBR latex, and styrene-acrylic acid ester.

Furthermore, in the thermosensitive coloring layer, the following additives can be contained in order to obtain clear images with a white background and to facilitate pencil-writing thereon:

inorganic and organic pigments, such as calcium carbonate, clay, talc, zinc oxide, polystyrene pigment and urea-formaldehyde resin pigment.

In order to attain smooth running of the thermal head over the thermosensitive recording material, that is, in order to improve the matching of the thermosensitive recording material with the thermal head, waxes, such as polyethylene wax, paraffin wax, carnauba wax, montan wax and metal salts of higher fatty acids, can be added in the thermosensitive coloring layer by conventional procedures.

The thermosensitive recording material according to the present invention can be prepared as follows.

The coloring material, the developing material, the binder agent and the above-mentioned additives, if necessary, are individually mixed with a protective colloidal material, such as polyvinyl alcohol or a surface active agent, in a dispersing apparatus, such a ball mill, attritor or sand mill, and the thermosensitive recording material is prepared, for example, in accordance with the formulation as explained in detail below. In the above, the components other than the coloring material can be mixed together at the same time.

EXAMPLE 1

Liquid A and liquid B were prepared by grinding the respective following components in a ball mill for 24 hours:

| | Parts by Weight |
|---|---|
| Liquid A | |
| 3-cyclohexylamino-6-methyl-7-anilinofluoran | 150 |
| 10% aqueous solution of polyvinyl alcohol | 150 |
| Water | 200 |
| Liquid B | |
| Ethyl p-hydroxybenzoate | 70 |
| 2,2'-methylene-bis(4-methyl-6-t-butylphenol) | 30 |
| Calcium stearate | 20 |
| Calcium carbonate | 100 |
| 10% aqueous solution of polyvinyl alcohol | 100 |
| Water | 180 |

One part by weight of the liquid A and 5 parts by weight of the liquid B were mixed and a thermosensitive coloring liquid was prepared. The thermosensitive coloring liquid was coated with a deposition of 5 g/m$^2$ by a wire bar on a sheet of high quality paper with a base weight of 52.3 g/m$^2$, and was then dried to form a thermosensitive coloring layer. The thus prepared thermosensitive recording material was subjected to calendering, so that the smoothness of the surface of the thermosensitive coloring layer was caused to be in the range of 200 to 300 in terms of Beck's smoothness, whereby a thermosensitive recording material No. 1 according to the present invention was prepared.

EXAMPLE 2

Example 1 was repeated except that the ethyl p-hydroxybenzoate in the liquid B was replaced by benzyl p-hydroxybenzoate, whereby a thermosensitive recording material No. 2 according to the present invention was prepared.

COMPARATIVE EXAMPLE 1

Example 1 was repeated except that the 2,2'-methylene-bis(4-methyl-6-t-butylphenol) in the liquid B was replaced by the same amount of water, whereby a comparative thermosensitive recording material No. 1 was prepared.

COMPARATIVE EXAMPLE 2

Example 2 was repeated except that the 2,2'-methylene-bis(4-methyl-6-t-butylphenol) in the liquid B was replaced by the same amount of water, whereby a comparative thermosensitive recording material No. 2 was prepared.

The thermosensitive recording materials Nos. 1 and 2 and the comparative thermosensitive recording materials Nos. 1 and 2 were subjected to a thermal response test, a visual inspection of the formed images and an image fading test.

The thermal response test was conducted by forming a solid image area on each of the above thermosensitive recording samples by a G-III mode facsimile apparatus provided with a thin-film thermal head to which electric power of 0.5 W/dot was applied for 2.2 msec and then by measuring the recorded image density immediately thereafter.

The visual inspection of the formed images was conducted by inspecting visually the formed images immediately after the formation thereof.

The image fading test was conducted by placing each sample with the images formed in the thermal response test, with the surface of each thermosensitive coloring layer up, for 7 days, in a room where the temperature was 20° C., the humidity was 65%RH and the illuminance was 500 lux, and then by comparing the image density of each sample immediately after the formation of images and the image density upon completion of the 7 days. The conditions of the room employed for this test were almost the same as those of ordinary offices.

The results of those tests are summarized in the following table:

| Sample | Thermal Response (Immediately after Printing) | Fading of Image After 7 Days | Fading of Image Difference | Uniformity of Image Density |
|---|---|---|---|---|
| Example 1 | 1.20 | 1.18 | −0.02 | Excellent |
| Example 2 | 1.24 | 1.26 | +0.02 | Excellent |
| Comp. 1 | 1.15 | 0.92 | −0.23 | Inferior |
| Comp. 2 | 1.21 | 1.15 | −0.06 | Good |

In the above table, the thermal response is indicated by the image density obtained immediately after printing. The fading of images is indicated by the image density obtained after 7 days, and the difference in the two values. For example, in the case case of Example 1, the difference is −0.02 (=1.18−1.20).

As can be seen from the above results, the thermosensitive recording materials according to the present invention are better in thermal response, image durability (cf. the fading of image) and uniformity of image density than the comparative examples.

What is claimed is:

1. A thermosensitive recording material comprising a support and a thermosensitive coloring layer formed on said support, said thermosensitive coloring layer comprising a colorless or light-colored coloring material and a developing material capable of developing the color of said coloring material upon application of heat to said thermosensitive coloring layer, wherein the improvement comprises: said developing material consists essentially of (i) at least one p-hydroxybenzoic acid ester of the formula:

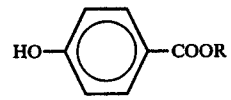

wherein R represents alkyl having 1 to 4 carbon atoms or benzyl, and (ii) at least one bisphenol derivative selected from the group consisting of:

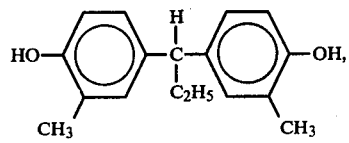

-continued

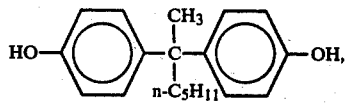

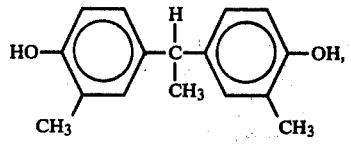

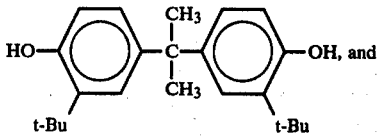

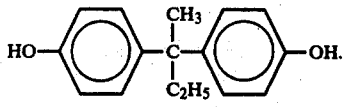

2. A thermosensitive recording material as claimed in claim 1 wherein the amount of said developing material is in the range of 1 to 10 parts by weight to 1 part by weight of said coloring material.

3. A thermosensitive recording material as claimed in claim 2, wherein the weight ratio of said p-hydroxybenzoic acid ester to said bisphenol derivative is in the range of 0.1 to 5.

4. A thermosensitive recording material as claimed in claim 1, wherein said coloring material is a leuco compound selected from the group consisting of triphenylmethane-type leuco compounds, fluoran-type leuco compounds, phenothiazine-type leuco compounds, auramine-type leuco compounds and spiropyran-type leuco compounds.

5. A thermosensitive recording material as claimed in claim 1, wherein said p-hydroxybenzoic acid ester is selected from the group consisting of methyl p-hydroxybenzoate, ethyl p-hydroxybenzoate, n-propyl p-hydroxybenzoate, iso-propyl p-hydroxybenzoate, isobutyl p-hydroxybenzoate, and benzyl p-hydroxybenzoate.

6. A thermosensitive recording material as claimed in claim 1, wherein said p-hydroxybenzoic acid ester is ethyl p-hydroxybenzoate or benzyl p-hydroxybenzoate.

7. A thermosensitive recording material as claimed in claim 1, wherein said thermosensitive layer further contains an effective amount of at least one additive selected from the group consisting of (1) a binder, (2) a pigment selected from the group consisting of calcium carbonate, calcium stearate, clay, talc, zinc oxide, polystyrene and urea-formaldehyde resin, (3) a wax, and (4) mixtures thereof.

8. A thermosensitive recording material as claimed in claim 7, wherein said additive consists of a mixture of polyvinyl alcohol, as said binder, and calcium carbonate and calcium stearate, as said pigment.

9. A thermosensitive recording material comprising a support and a thermosensitive coloring layer formed on said support, said thermosensitive coloring layer consisting essentially of (1) a colorless or light-colored coloring material, (2) 1 to 10 parts by weight, per 1 part by weight of said coloring material, of a developing material capable of developing the color of said coloring material upon application of heat to said thermosensitive coloring layer, said developing material consisting essentially of (i) at least one p-hydroxybenzoic acid ester of the formula:

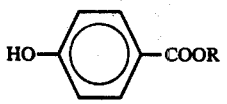

wherein R represents alkyl having 1 to 4 carbon atoms or benzyl, and (ii) at least one bisphenol derivative selected from the group consisting of:

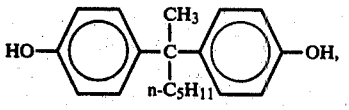

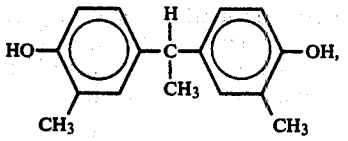

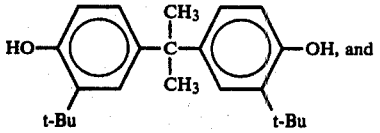

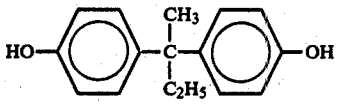

wherein the weight ratio of (i) to (ii) is in the range of 0.1 to 5, (3) a pigment selected from the group consisting of calcium carbonate, calcium stearate, clay, talc, zinc oxide, polystyrene and urea-formaldehyde resin, and (4) a binder.

10. A thermosensitive recording material as claimed in claim 9, wherein said coloring material is selected from the group consisting of triphenylmethane-type leuco compounds of the general formula:

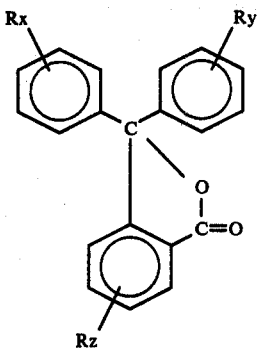

wherein Rx, Ry and Rz each represent hydrogen, hydroxyl, halogen, alkyl, nitro, amino, dialkylamino, monoalkylamino or aryl, and lactone compounds of the general formula:

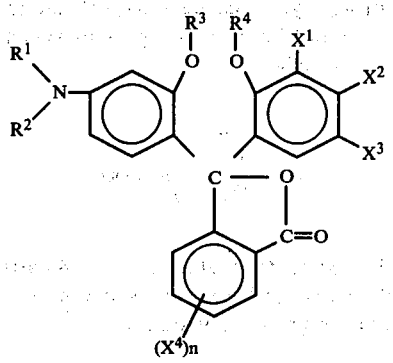

wherein $R^1$ and $R^2$ each represent hydrogen, lower alkyl, substituted or unsubstituted aralkyl, substituted or unsubstituted phenyl, cyanoethyl, or $\beta$-halogenated ethyl, or $R^1$ and $R^2$ in combination represent $—CH_2—_4$, $—CH_2—_5$, or $—CH_2—_2O—CH_2—_2$, $R^3$ and $R^4$ each represent hydrogen, lower alkyl, amino or phenyl, and one of $R^3$ or $R^4$ is hydrogen, $X^1$, $X^2$ and $X^3$ each represent hydrogen, lower alkyl, lower alkoxy, halogen, halogenated methyl, nitro, or substituted or unsubstituted amino, $X^4$ represents hydrogen, halogen or lower alkyl, and n is an integer 0 to 4.

11. A thermosensitive recording material as claimed in claim 9, wherein said coloring material is selected from the group consisting of fluoran-type leuco compounds of the general formula

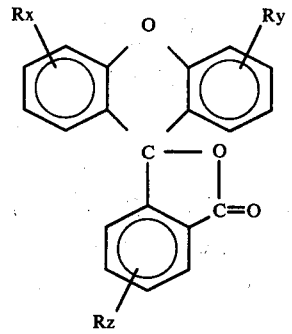

wherein Rx, Ry and Rz are each hydrogen, hydroxyl, halogen, alkyl, nitro, amino, dialkylamino, monoalkylamino or aryl.

* * * * *